United States Patent [19]

Tuttrup

[11] 4,373,419

[45] Feb. 15, 1983

[54] DRUM APPARATUS

[76] Inventor: Gene J. Tuttrup, 12 Vista Villa Park, Waseca, Minn. 36093

[21] Appl. No.: 224,428

[22] Filed: Jan. 12, 1981

[51] Int. Cl.[3] ..... G10D 13/02

[52] U.S. Cl. ..... 84/411 R; 84/413

[58] Field of Search ..... 84/411–420; D17/22

[56] References Cited

U.S. PATENT DOCUMENTS

| | | | |
|---|---|---|---|
| 407,579 | 7/1889 | Cubley | 84/415 |
| 2,485,985 | 10/1949 | Perry | 84/411 R |
| 3,029,679 | 4/1962 | La Londe | 84/411 R |
| 3,747,463 | 7/1973 | Hinger | 84/419 |
| 3,818,791 | 6/1974 | Zickos | 84/411 R |
| 4,244,265 | 1/1981 | Tuttrup | 84/411 R |

OTHER PUBLICATIONS

Latin Percussion advertisement, ©1974, p. 3, Conga Drum.

*Primary Examiner*—Lawrence R. Franklin
*Attorney, Agent, or Firm*—James C. Wray

[57] ABSTRACT

Drums have a truncated spherical sidewall section formed integrally with a truncated conical sidewall section. The spherical section is one-half to four-fifths the length of the drum body and it curves about a point located 20% to 40% of the distance between the ends of the drum body. The conical section slopes inward 30° to 40° from vertical. A cylindrical sidewall section extends between the spherical section and the end of the drum. A drum head is stretched across an end of the drum body by tightening bolts which extend through slots in a hoop surrounding the head. The bolts have threaded ends which are received in tapped rods rotatably mounted in the curled ends of sheet elements. The bolts pivot about an axis tangential to the drum body. Radially extending portions of the hoop have bent edges adjacent the bolt heads. The slots are formed in portions of the hoop which project toward the end of the drum.

25 Claims, 7 Drawing Figures

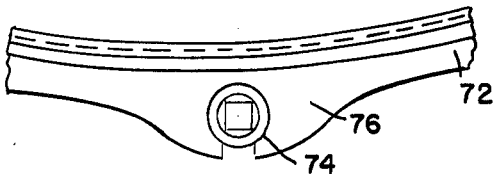
FIG. 6
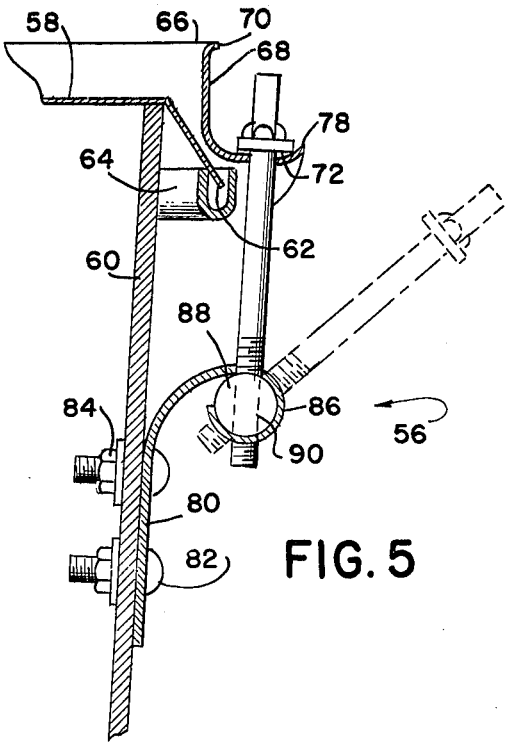
FIG. 5
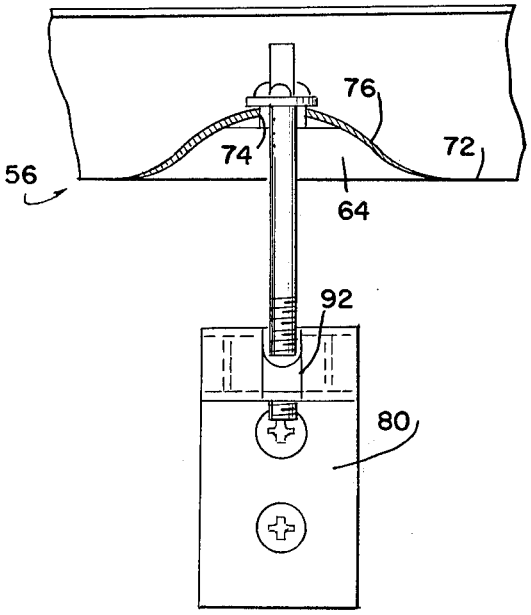
FIG. 4
FIG. 7
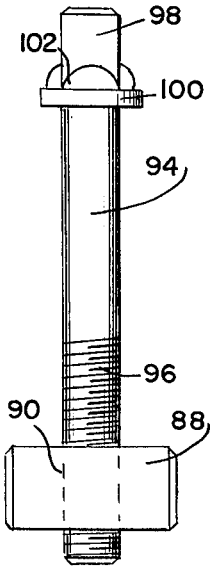

DRUM APPARATUS

BACKGROUND OF THE INVENTION

This invention relates generally to musical instruments and more particularly has reference to drums.

Different types of percussion instruments in the form of drums are available for producing sounds. Various means of tuning drums are also available. Drums usually have cylindrical bodies with drum heads at one or both ends. Drums are conventionally tuned by shortening or lengthening bolts extending through hoops which stretch the drum heads over the open ends of the drum. The bolts are received in fixed lugs.

Pertinent United States and foreign patents are found in Class 84, subclasses 304, 411, 411A, 413, 415, 421, 422, 430, 432, 442, 454, 458, and Digest 18 of the Official Classification of Patents in the United States Patent and Trademark Office.

Examples of pertinent patents are

| U.S. Pat. Nos. | |
|---|---|
| 283,352 | 674,550 |
| 804,347 | 973,661 |
| 1,090,426 | 1,312,771 |
| 1,356,193 | 1,609,786 |
| 1,722,032 | 1,980,876 |
| 2,074,193 | 2,173,443 |
| 2,495,451 | 2,617,325 |
| 3,021,743 | 3,113,481 |
| 3,185,013 | 3,215,019 |
| 3,215,021 | 3,439,573 |
| 4,048,895 | 4,112,807 |
| Design Patent No. 229,776 | |
| Foreign Patent Numbers | |
| Austrian 87,629 | |
| British 592,979 and 815,297 | |
| French 695,192 | |
| German 510,976 | |
| Italian 430,279. | |

Relevant drum shapes and tensioning apparatus are also disclosed in my co-pending application Ser. No. 945,032, filed Sept. 22, 1978, now U.S. Pat. No. 4,244,265.

A number of the foregoing patents are of interest for their disclosures of drum shapes.

U.S. Pat. No. 1,980,876 shows a drum having concavely curved sidewalls.

U.S. Pat. No. 4,112,807 and French Pat. No. 695,192 show drums having cylindrical portions and truncated conical portions.

German Pat. No. 510,976 shows a drum having an inverted cone shaped drum body.

U.S. Pat. No. Des. 229,776 shows a bass kettle for a muscial drum having a slanting cylindrical drum body and a closed curved end.

Application Ser. No. 945,032 shows a drum body having a first sidewall section sloping slightly inward and a second sidewall section sloping inward from the first sidewall section at a substantially greater angle than the first sidewall section.

The remaining patents are of interest for their disclosures of tensioning mechanisms.

U.S. Pat. No. 674,550 shows a drum head tightening mechanism wherein screws are provided with an enlarged head or collar and an angular or square extension. The head is adapted to rest in a recessed countersunk portion in the top of an angle plate.

U.S. Pat. No. 973,661 shows a drum head tightener which uses clips comprising a hook-shaped extremity adapted to project over and engage the outer edge of a drum encircling ring U.S. Pat. No. 1,722,032 shows a series of hoops used to connect turn buckles. The hoops provide countertension.

U.S. Pat. No. 1,090,426 shows a drum head tightening mechanism which uses a series of bar posts.

U.S. Pat. No. 3,113,481 shows a snare drum. A ring around the drum has raised portions. The raised portions provide retention. for the tightening elements.

U.S. Pat. No. 1,609,786 shows a snare strainer. An adjusting screw is threaded into a post.

Single lever tuning devices are shown in British Pat. No. 592,979, British Pat. No. 815,297, Italian Pat. No. 430,279, Austrian Pat. No. 87,629 and U.S. Pat. Nos. 3,021,743, 1,356,193, 4,048,895 and 2,173,443.

U.S. Pat. Nos. 804,347, 1,312,771, 283,352, 3,439,573, 3,215,021, 2,074,193, 3,185,013, 3,215,019, 2,495,451 and 2,617,325 show a variety of tensioning mechanisms for drums.

SUMMARY OF THE INVENTION

The present invention provides a unique drum shape. The drum of the present invention has a truncated spherical sidewall section formed integrally with a truncated conical sidewall section. The spherical section is ½ to 4/5 the length of the drum body. The conical section slopes inward 30° to 40° from vertical. A cylindrical sidewall section extends between the spherical section and the end of the drum.

The present invention also provides a unique releasable tensioning mechanism for drums. The tensioning bolts have threaded ends which are received in tapped rods rotatably mounted in the curled ends of sheet elements. The bolts thus pivot about an axis tangential to the drum body. When pivoted to an outward position, the bolts are released from the hoop surrounding the drum head, thus permitting removal of the hoop. When the bolts are pivoted to an upright position, they engage slots formed in the hoop to secure the hoop to the drum. The drum head is tightened by screwing the bolts into the tapped rods. The slots are formed in portions of the hoop which project toward the ends of the drum. Edges of the hoop adjacent the bolt heads are bent.

One object of the invention is, therefore, to provide an improved drum.

Another object of the invention is to provide a drum having a unique shape.

Yet another object of the invention is to provide a drum having a truncated spherical sidewall section and a truncated conical sidewall section.

Still another object of the invention is to provide a drum body having a first open end and a smaller second open end opposite the first open end, the body having first and second sidewall sections, the first sidewall section curving convexly and the second sidewall section sloping inwardly from the first sidewall section.

A further object of the invention is to provide an improved tensioning mechanism for drums.

Another object of the invention is to provide a tensioning mechanism which facilitates quick and easy removal of the drum head.

Still another object of the invention is to provide apparatus for adjusting the tension of a drum head stretched across an end of a drum body comprising a pivotal member, means for mounting said member for pivotal movement about an axis substantially tangential to the sidewall of the drum body, a link connected to the pivotal member for pivotal movement therewith, said link being provided with connecting means for connecting the drum head to the end of the drum body, and adjustment means connected to the link for adjusting the position of the connecting means relative to the end of the drum body and thereby adjusting the tension of the drum head.

These and other and further objects and features of the invention are apparent in the disclosure which includes the above the below specification and claims and drawings.

BRIEF DESCRIPTION OF THE DRAWINGS

FIG. 4 is a front elevational view of the tensioning mechanism of the present invention.

FIG. 5 is a side view, partly in section, of the tensioning mechanism shown in FIG. 4.

FIG. 6 is a top plan view of the mechanism shown in FIGS. 4 and 5.

FIG. 7 is a detailed view of the lug and tapped rod shown in FIGS. 4 and 5.

DETAILED DESCRIPTION OF THE INVENTION

Figure 1:
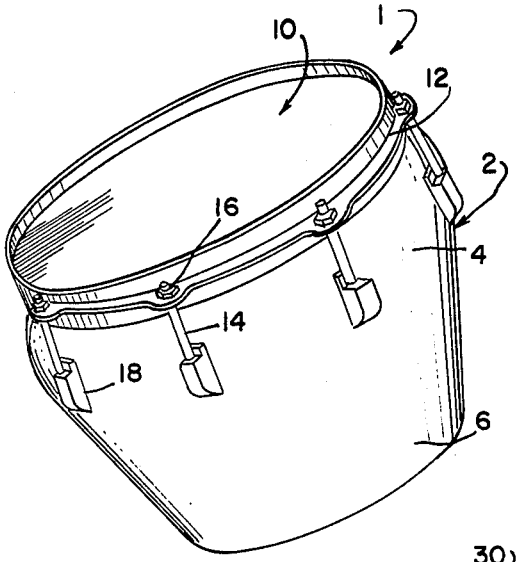
FIG. 1 is a perspective view of a drum embodying features of the present invention.

Referring to FIG. 1, a drum embodying features of the present invention is generally referred to by the numeral 1. The drum has a body 2 with an upper section 4 and a lower section 6. A drum head 10 is stretched across the open upper end of the body 2 by a hoop 12. A plurality of threaded rods 14 extend downward through openings in the hoop 12. The rods 14 are formed with heads 16 and are similar to bolts. Receivers 18 mounted on the body 2 contain threaded nut-like elements. Applying an adjusting wrench or drum key to the heads 16 of the rods 14 and turning the rods 14, moves the hoop 12 and adjusts the tension on the head 10, changing the pitch of the drum 1.

Figure 2:
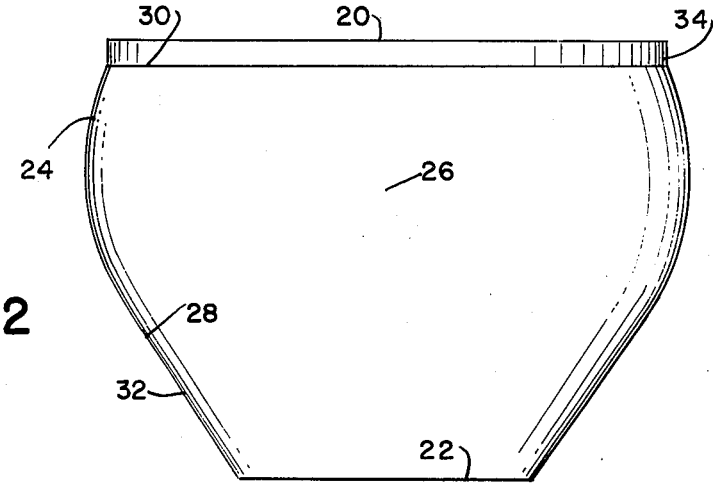
FIG. 2 is a side elevational view of the drum body shown in FIG. 1.

The shape of the drum body 2 is shown in greater detail in FIG. 2.

The drum body 2 has an open upper end 20 and an open lower end 22. The upper end 20 is larger than the lower end 22.

The upper section 4 of the drum body 2 has a truncated spherical shape. The outer surface 24 is curved convexly about a point on the drum axis which can be located in the range of about 20% to about 40% of the distance between the large open end 20 and the small open end 22. The point 26 shown in FIG. 2 is located about one quarter of the distance between the large open end 20 and the small open end 22. The lower end 28 of the upper section 4 terminates radially inwardly of the upper end 30 of the upper section 4.

The lower section 6 has a truncated conical shape. The outer surface 32 tapers inwardly from the lower end 28 of the upper section 4 to the smaller open end 22. The outer surface can have a slope of about 30° to about 40° from vertical. The outer surface 32 shown in FIG. 2 slopes inward about 35° from vertical. A cylindrical section 34 extends between the upper end 30 of the upper section 4 and the large open end 20.

Preferably, the upper section 4 and the lower section 6 have lengths which are substantially greater than the length of the cylindrical section 34. Preferably, the upper section is in the range of about ½ to about 4/5 of the length of the drum body. The truncated spherical section 4 shown in FIG. 2 is about 4/7 of the length of the drum body 2. The truncated conical section 6 shown in FIG. 2 has a length somewhat less than the length of the truncated spherical section.

Figure 3:
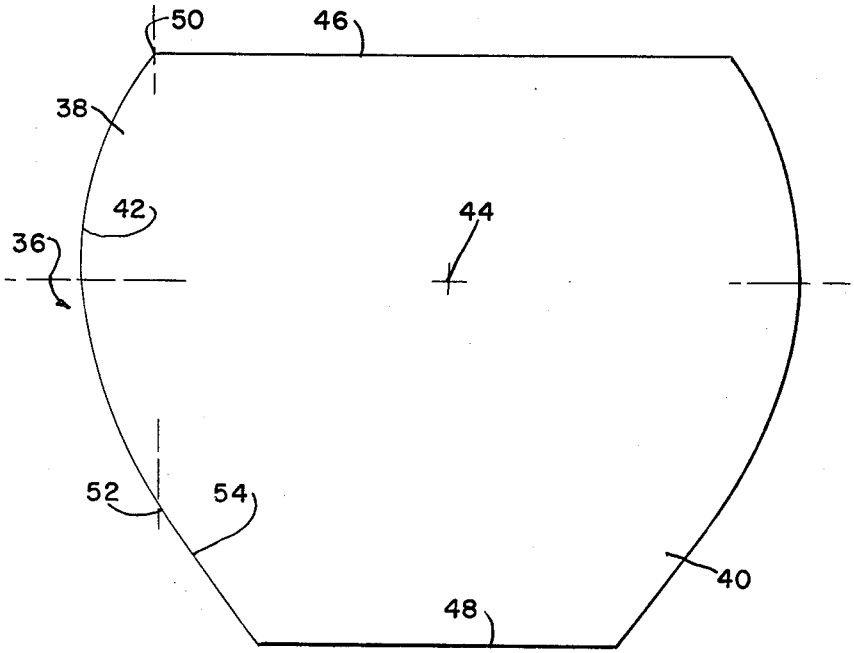
FIG. 3 is a side elevational view of another drum body embodying features of the present invention.

An alternative embodiment of the drum body of the present invention is shown in FIG. 3. The drum body 36 has an upper section 38 and a lower section 40. The drum body 36 can be provided with the drum head 10, ring 12, threaded rods 14 and receivers 18 shown in FIG. 1.

The upper section 38 of the drum body 36 has a truncated spherical shape. The outer surface 42 is curved convexly about a point on the drum axis which can be located in the range of about 20% to about 40% of the distance between the large open end 46 and the small open end 48 of the drum body 36. The point 44 shown in FIG. 3 is located about ⅜ of the distance between the large open end 46 and the small open end 48. The upper end 50 of the upper section 38 is aligned with the lower end 52 of the upper section 58.

The lower section 40 has a truncated conical shape. The outer surface 54 of the lower section 40 tapers inwardly from the lower end 52 of the upper section 38 to the smaller open end 48. The outer surface can slope inward in the range of about 30° to about 40° from vertical. The outer surface 54 shown in FIG. 3 slopes inward about 37° from vertical.

Preferably, the length of the upper section 38 is substantially greater than the length of the lower section 40. The upper section can be in the range of about ½ to about 4/5 of the length of the drum body. The upper section 38 shown in FIG. 3 is about ¾ of the length of the drum body.

Preferably, the upper and lower sections of the drum body are formed integrally. The drum body can be made from any conventional drum body material, such as wood or metal.

As previously noted, the larger open end of the drum body is closed by a drum head. In one embodiment, the drum head is provided with variable tensioning means, such as that shown in FIG. 1. Alternatively, the drum head or skin is stretched across the large open end and permanently connected to the upper edge of the drum body.

The smaller open end of the drum body is preferably left uncovered. However, if desired, the smaller end can be provided with a drum head and tensioning means similar to those shown in FIG. 1 or it can be provided with a permanently attached drum skin similar to that previously described.

The tensioning mechanism of the present invention is shown in FIGS. 4–7 and is generally indicated by the numeral 56. The tensioning mechanism can be used on the drum bodies shown in FIGS. 2 and 3 or it can be used on any conventional drum body.

Referring to FIG. 5, a drum head 58 is shown stretched over the end of a drum body 60. The head 58 has attached to an outer circular edge 62 thereof a retaining ring 64 which may be bonded to the edge 62 of the drum head 58 or integrally formed therewith. That drum head construction is conventional and well known.

A hoop 66 encircles the drum head 58. The hoop 66 is formed of metal or other rigid material. The hoop 66 has a vertical portion 68 which terminates outwardly in a rounded edge 70. A radial portion 72 extends outwardly from the lower end of the vertical portion 68. The radial portion 72 overlies the retaining ring 64.

The radial portion 72 of the hoop 66 is provided with radial slots 74 as shown in FIG. 6. The number of slots provided and the spacing between the slots can be varied as required. Preferably, however, the hoop 66 is provided with slots 74 at eight equally spaced locations about the circumference of the hoop 66.

The areas of the radial portion 72 in which the slots 74 are formed can have any desired configuration. Preferably, however, the areas have the configuration shown in FIGS. 4–6. As shown in FIG. 4, the slots 74 are formed in areas 76 of the radial portion 72 which project toward the end of the drum. When viewed from the side, the areas 76 have a shape generally resembling a bell curve. The slots 74 are formed in the crest of the curve. As shown in FIG. 6, the areas 76 provided with the slots 74 also project radially outwardly from the drum body. In plan view, those projections also have a shape generally resembling a bell curve, with the slot being provided at the crest of the curve. Referring to FIG. 5, it can be seen that the radially outward ends of the radial portion 72 are bent or turned up on both sides of the radial slots 74. These bends serve a locking function which will be described in greater detail later.

Sheet elements 80 are bolted to the drum body 60 by bolts 82 and nuts 84. The ends 86 of the sheet elements 80 are curled. The sheet elements 80 are aligned with the radial slots 74 and spaced a distance therefrom.

The sheet elements 80 can be formed of any conventional material. Preferably, however, the sheet elements 80 are formed of sixteen gauge stainless steel.

The sheet elements 80 can be sized to suit particular applications. Preferably, however, the sheet elements have a width of 1 inch, a height of $1\frac{3}{4}$ inches, and a distance of $\frac{7}{8}$ inches from the drum body to the radially outermost surface of the curled end 86.

Cylindrical rods 88 are positioned in the curled ends 86 of the sheet elements 80 and rotatably supported thereby. The cylindrical rods 88 have cylindrical outer surfaces which conform generally to the cylindrical inner surfaces of the curled ends 86 of the sheet elements 80. The cylindrical rods 80 are provided with tapped central bores 90. The bores 90 are aligned with slots 92 formed in the curled ends 86 of the sheet elements 80.

Bolts 94 have threaded ends 96 which extend through the slots 92 and are screwed into the bores 90. The outward ends 98 of the bolts 94 are provided with radial flanges 100 and bolt heads 102. The radial flanges are configured to engage the radial portion 72 of the hoop 66 in the areas 76 provided with slots 74. The bolt heads 102 are sized and shaped to be received within conventional drum keys.

Use of the tensioning mechanism can now be readily understood.

Initially, the ends of the drum body 60 are open. To ready the drum for use, a drum head 58 is placed over the end of the drum body 60 and the circular retaining ring is placed in the position shown in FIG. 5. The hoop 66 is placed over the drum head so that the radial portion 72 comes into contact with the retaining ring 64.

While the drum head 58 and hoop 66 are being installed, the bolts 94 are left in the position shown in dotted lines in FIG. 5. The bolts 94 are held in that position by the ends of the slots 92.

The hoop 66 is rotated until the slots 74 are aligned with the bolts 94. The bolts 94 are then pivoted toward the drum body 60 and are received by the radial slots 74. The bolts must be adjusted so that the distance between the cylindrical rods 88 and the radial flanges 100 is sufficient to permit the flanges 100 to fit over the turned up outward ends 78 of the hoop 66 and come to rest on the radial portion 72 of the hoop 66.

A conventional drum key is placed over the bolt head of one bolt 94 and rotated until resistance is encountered. The drum key is removed from that bolt and transferred to an adjacent bolt. That bolt is rotated until resistance is encountered. That procedure continues sequentially around the drum until each bolt has been tightened slightly.

As the bolts 94 are rotated, the distance between the radial flanges 100 and the cylindrical rods 88 decreases. The radial flanges 100 bear against the radial portion 72 of the hoop 66, thus urging the retaining ring 64 toward the center of the drum. The head 58 is thus stretched across the end of the drum body 60 and tightened. The drum head 58 is tensioned to the desired pitch by repeated sequential tightening of the bolts 94.

The turned up ends 78 of the radial portion 72 prevent the bolts 94 from pivoting away from the drum body. The function is most important before the bolts have been tightened.

Drum heads frequently break or wear out and thus must be replaced. With conventional tightening mechanisms, the drum head cannot be removed until all of the tensioning bolts have been fully unscrewed from their receiving lugs. That is a very laborious and time consuming procedure.

The present invention avoids that problem. In the present invention, the drum head 58 can be removed by simply loosening the bolts 94 and pivoting them outwardly from the drum body 60. The bolts 94 need only be loosened enough to permit the flanges 100 to pass over the turned up ends 78 of the hoop 66.

The hoop 66 and broken drum head 58 are removed, the broken head 58 replaced, and the new head attached to the drum in the manner described above.

While the invention has been described with reference to a specific embodiment, the exact nature and scope of the invention is defined in the following claims.

I claim:

1. Percussion instrument apparatus comprising a drum body having a first open end and a smaller second open end opposite the first open end, the body having first and second sidewall sections, the first sidewall section comprising a truncated spherical section curving convexly and the second sidewall section comprising a truncated conical section sloping inwardly from the first sidewall section.

2. The apparatus of claim 1 wherein the length of the first sidewall section is greater than the length of the second sidewall section.

3. The apparatus of claim 1 wherein the first sidewall section is in the range of about $\frac{1}{2}$ to about 4/5 the length of the drum body.

4. The apparatus of claim 1 wherein the lower edge of the first sidewall section terminates inwardly from the upper edge of the first sidewall section.

5. The apparatus of claim 1 wherein the second sidewall section slopes inward in the range of about 30° to about 40° from vertical.

6. The apparatus of claim 1 wherein the first sidewall section curves about a point located in the range of about 20% to about 40% of the distance between the first open end and the second open end.

7. The apparatus of claim 1 wherein the upper edge of the first sidewall section is aligned with the lower edge of the first sidewall section.

8. The apparatus of claim 1 wherein the drum body is further provided with a cylindrical sidewall section extending between the first open end and the first sidewall section.

9. The apparatus of claim 8 wherein the lengths of the first and second sidewall sections are substantially greater than the length of the cylindrical sidewall section.

10. The apparatus of claim 1 wherein the second sidewall section slopes inward about 35° from vertical.

11. The apparatus of claim 1 wherein the second sidewall section slopes inward about 37° from vertical.

12. The apparatus of claim 1 wherein the first sidewall section is about ¾ the length of the drum body.

13. The apparatus of claim 1 wherein the first sidewall section is about 4/7 the length of the drum body.

14. The apparatus of claim 1 wherein the first sidewall section curves about a point located about ⅜ of the distance between the first open end and the second open end.

15. The apparatus of claim 1 wherein the first sidewall section curves about a point located about ¼ the distance between the first open end and the second open end.

16. The apparatus of claim 1 further comprising means for adjusting tension of a drum head stretched across an end of the drum body, said means comprising a pivotal member, means for mounting said member for pivotal movement about an axis substantially tangential to a sidewall of the drum body, a link connected to the pivotal member for pivotal movement therewith, said link being provided with connecting means for connecting the drum head to the end of the drum body, and adjustment means connected to the link for adjusting the position of the connecting means relative to the end of the drum body and thereby adjusting the tension of the drum head.

17. The apparatus of claim 16 wherein the mounting means comprises a support element configured to engage the pivotal member, said support element being provided with a curved inner surface, and the pivotal member comprises a rotatable element having a generally complementary curved outer surface.

18. The apparatus of claim 17 wherein said curved inner surface of said support element is a cylindrical surface and said curved outer surface of said rotatable element is a complementary cylindrical surface.

19. The apparatus of claim 16 wherein the connecting means comprises a radially extending flange formed on an end of the link remote from the pivotal member.

20. The apparatus of claim 16 wherein the connecting means is connected to the link at a point spaced from the pivotal member, and the adjusting means comprises screw threads formed on the link and complementary screw threads formed in a bore in the pivotal member, said link being screwed into said pivotal member to adjust the position of the connecting means relative to the pivotal member.

21. The apparatus of claim 16 wherein the connecting means comprises a radially extending flange formed on an end of the link remote from the pivotal member, and a hoop configured to engage the edge of the drum head extending radially outwardly from the sidewall of the drum body and to receive pressure from the flange and to communicate said pressure to said edge of said drum head, said hoop being provided with a radial slot configured to accommodate a portion of the link below said flange and to thereby establish communication between said flange and said hoop.

22. The apparatus of claim 21 wherein said slot is formed in a portion of said hoop extending radially outward from the drum body and terminating outwardly of said flange in portions bent about said flange adjacent said slot.

23. The apparatus of claim 21 wherein said slot is formed in a portion of said hoop projecting outwardly toward the end of the drum body.

24. Percussion instrument apparatus comprising a drum body having a first open end and a smaller second open end opposite the first open end, the body having first and second sidewall sections, the first sidewall section curving convexly and the second sidewall section sloping inwardly from the first sidewall section, and means for adjusting tension of a drum head stretched across an end of the drum body, said means comprising a pivotal member, a sheet element having a curled end configured to engage and support the pivotal member for mounting said member for pivotal movement about an axis substantially tangential to a sidewall of the drum body, a link connected to the pivotal member for pivotal movement therewith, said link being provided with connecting means for connecting the drum head to the end of the drum body, and adjustment means connected to the link for adjusting the position of the connecting means relative to the end of the drum body and thereby adjusting the tension of the drum head.

25. The apparatus of claim 24 wherein the link extends through a slot formed in the curled end of said sheet element.

* * * * *